United States Patent [19]

Bickley et al.

[11] Patent Number: 4,623,856

[45] Date of Patent: Nov. 18, 1986

[54] INCREMENTALLY TUNED RF FILTER HAVING PIN DIODE SWITCHED LINES

[75] Inventors: Robert H. Bickley, Scottsdale; Steven A. Murray, Mesa, both of Ariz.

[73] Assignee: Motorola, Inc., Schaumburg, Ill.

[21] Appl. No.: 619,523

[22] Filed: Jun. 11, 1984

[51] Int. Cl.[4] ..... H01P 1/203

[52] U.S. Cl. ..... 333/205; 333/235

[58] Field of Search ..... 333/202–205, 333/219–221, 235, 246, 17 R, 132, 134, 101, 103, 104; 334/45, 47, 55, 56, 60, 69, 71, 15; 455/179, 180, 187, 188, 191, 193, 124

[56] References Cited

U.S. PATENT DOCUMENTS

| | | | |
|---|---|---|---|
| 3,482,178 | 12/1969 | Habian | 334/47 |
| 3,593,225 | 7/1971 | Fisher | 333/240 X |
| 4,186,360 | 1/1980 | Ohashi | 334/55 |
| 4,250,475 | 2/1981 | Schwarzmann | 333/205 |
| 4,267,538 | 5/1981 | Assal et al. | 333/246 X |
| 4,467,296 | 8/1984 | Cohen et al. | 333/205 X |

*Primary Examiner*—Eugene R. Laroche
*Assistant Examiner*—Benny Lee
*Attorney, Agent, or Firm*—Eugene A. Parsons

[57] ABSTRACT

A length of transmission line having a plurality of capacitors and a plurality of shorter lengths of transmission line coupled thereto by pin diodes which are individually operable to connect any combination of capacitors and transmission lines to the basic transmission line for changing the center frequency thereof in incremental steps across a desired band of frequencies.

10 Claims, 9 Drawing Figures

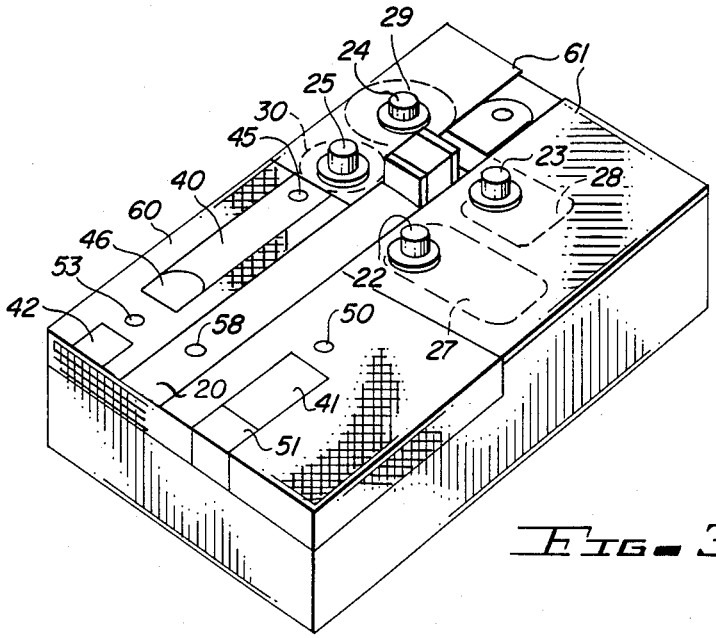
FIG. 3
FIG. 4
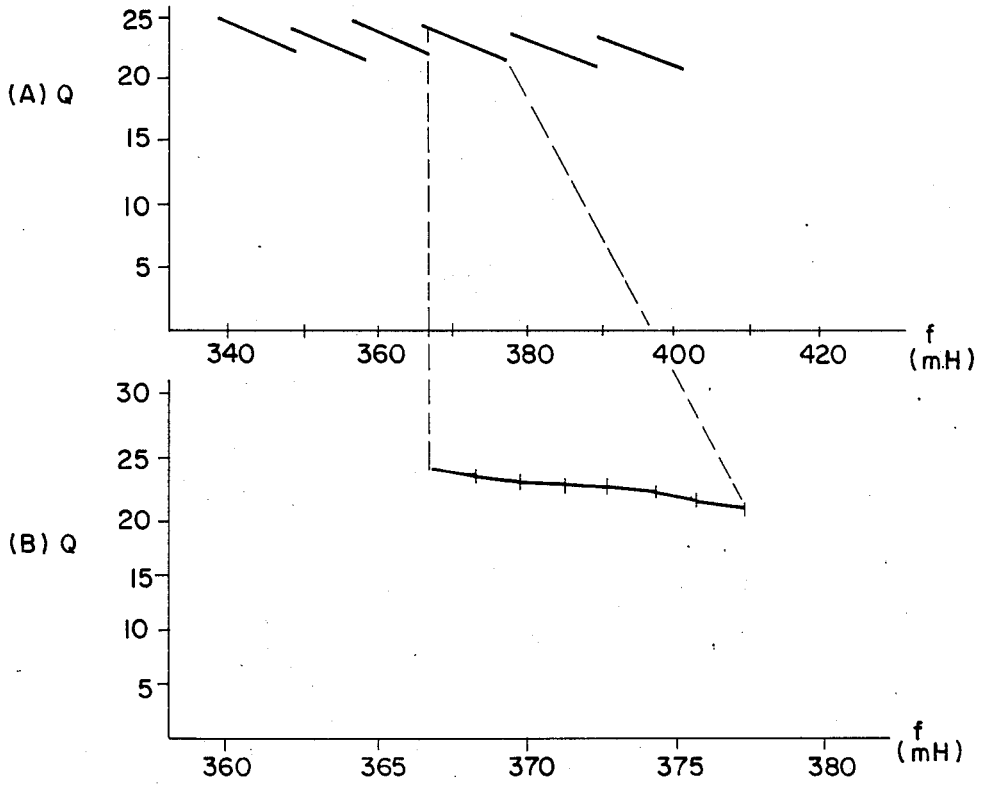

INCREMENTALLY TUNED RF FILTER HAVING PIN DIODE SWITCHED LINES

BACKGROUND OF THE INVENTION

In the construction of electronically tuned resonators or oscillators, especially those used in transmitters and the like, and in the front ends of communications receivers a plurality of filters, or resonant circuits, are required to allow the apparatus to operate at any of a variety of channels, or center frequencies. In the prior art a separate filter, or resonant circuit, is provided for each desired center frequency or channel and the entire filter is switched when the apparatus is changed to a different channel. Some attempts have been made at switching a variety of resonant circuits in an oscillator, for example, but this is very difficult to accomplish, especially at higher frequencies. Also, in most instances, the prior art structures require large amounts of power to operate the switching devices and extensive space for the mounting and housing thereof.

SUMMARY OF THE INVENTION

The present invention pertains to an electronically and incrementally tuned RF filter, or resonator, including a first length of transmission line, a plurality of second lengths of transmission line mounted adjacent to said first length to provide RF coupling therebetween, a plurality of capacitors and a plurality of PIN diodes connected to selectively couple the capacitors and/or the effective coupled impedance due to the second lengths of transmission line to the first length of transmission line to change the center frequency thereof in incremental steps across a desired band of frequencies.

It is an object of the present invention to provide a new and improved incrementally tuned RF filter or resonator.

It is a further object of the present invention to provide an incrementally tuned RF filter or resonator which has a compact size, fast switching and high power handling abilities.

It is a further object of the present invention to provide an incrementally tuned RF filter or resonator which has a high repeatability to reduce manufacturing costs and which is otherwise economical to reproduce.

These and other objects of this invention will become apparent to those skilled in the art upon consideration of the accompanying specification, claims and drawings.

BRIEF DESCRIPTION OF THE DRAWINGS

Referring to the drawings:

FIG. 3 is a perspective view of a partially assembled embodiment of the structure of FIG. 1;

FIGS. 4 A and B illustrate the ranges of frequencies for various modes of operation of the structure of FIG. 1;

DESCRIPTION OF THE PREFERRED EMBODIMENTS

Figure 1:
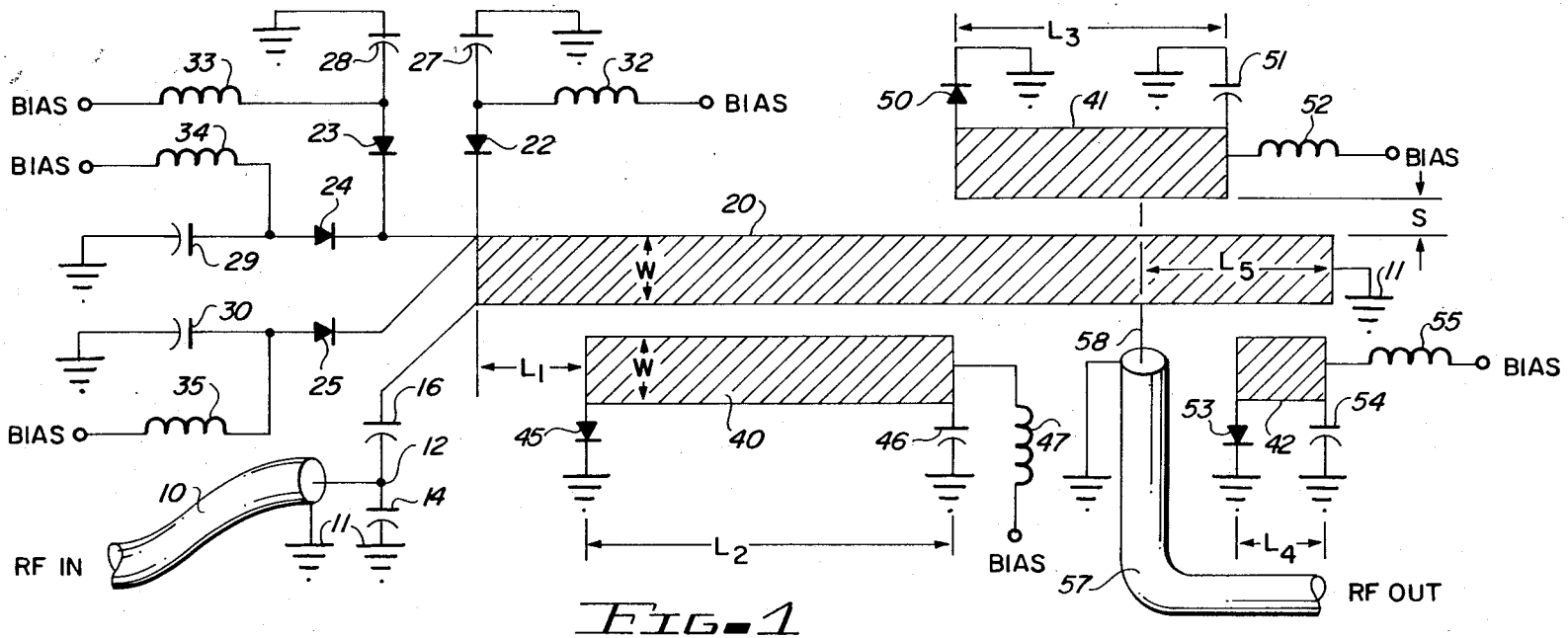
FIG. 1 is a schematic diagram of an incrementally tuned RF filter embodying the present invention.

Referring specifically to FIG. 1, a schematic diagram of an incrementally tuned RF filter, or resonator, is illustrated. A section of coaxial transmission line 10 is utilized as an RF input to the structure with the outer casing connected to a ground plane or electrical common point 11 and the inner conductor connected to a junction 12. Junction 12 is coupled through a capacitor 14 to the ground 11 and through a capacitor 16 to one end of a first length of transmission line 20. The capacitors 14 and 16 provide an impedance matching between the coaxial transmission line 10 and the resistance at resonance existing at transmission line 20. It will of course be understood by those skilled in the art that other types of input circuitry might be utilized, such as inductive coupling, etc. and the present signal input is illustrated because of its simplicity.

The cathodes of four PIN diodes 22 through 25 are also connected to the one end of the transmission line 20. The anodes of the four PIN diodes 22 through 25 are connected through capacitors 27 through 30, respectively, to ground plane 11. The junction of the anodes of PIN diodes 22 through 25 and the capacitors 27 through 30 each have an RF choke 32 through 35 connected thereto, which chokes are adapted to have a bias applied thereto for operating PIN diodes 22 through 25 into conducting and nonconducting modes. The PIN diodes 22 through 25 are such that upon conducting the resistance therethrough is approximately 0.3 of an ohm and when reverse biased the resistance is greater than 10 kilohms in parallel with a small capacitance. Thus, in the conducting mode the PIN diodes are essentially a short-circuit and in the nonconducting mode the PIN diodes are essentially a small capacitance. The RF chokes 32 through 35 minimize the RF present on the transmission line 20 from being coupled into the bias circuitry. Conversely, the bias will be a DC voltage which will be uneffected by the RF chokes 32 through 35. It will of course be understood by those skilled in the art that the specific embodiment illustrated could be altered, as for example PIN diodes 22 through 25 and capacitors 27 through 30 could be interchanged, but the present embodiment is illustrated because it positively disconnects the capacitors 27 through 30 and bias chokes 32 through 35 from the circuit when the PIN diodes 22 through 25 are in the nonconducting mode.

Three lengths of transmission line 40, 41 and 42 are mounted adjacent to the first transmission line 20 so as to provide RF coupling therebetween. One end of the length of transmission line 40 is coupled to ground through a PIN diode 45. The other end of the transmission line 40 is connected to ground through a capacitor 46, which provides an RF coupling to ground. The end having the RF coupling to ground also has an RF choke 47 connected thereto and adapted to receive a bias thereon for operating PIN diode 45. The bias is supplied at the end of the transmission line which is basically at RF ground so that little or no RF is present and the choke 47, which prevents RF from being applied to the bias source, is not critical. Transmission line 41 is coupled to ground at one end by PIN diode 50 and the other end is coupled to ground through an RF coupling capacitor 51 and is also adapted to have a bias source supplied thereto through an RF choke 52. Transmission line 42 is coupled to ground at one end by a PIN diode 53 with the other end being coupled to ground through an RF coupling capacitor 54 and to a bias source through an RF choke 55. In the present embodiment three different lengths of transmission line are mounted adjacent to the first length of transmission line 20, with none of the lengths overlapping to simplify the analysis of the effect on the length of transmission line 20. However, it will be understood by those skilled in the art that additional lengths of transmission line might be utilized and that RF coupling between the second lengths of transmission line might be provided, even though the effects on the first length of transmission line will be more complicated to analyze.

A section of coaxial transmission line 57 is provided for the RF output from the filter with the outer conductor being connected to ground and the inner conductor being connected to the first length of transmission line 20 at a position 58 spaced from the second end thereof. The second end of the length of transmission line 20 is connected to ground plane 11 so that the connection of the output transmission line 57 positioned in spaced relation therefrom is essentially similar to a tapped output coil. An equivalent circuit for the structure of FIG. 1 is illustrated schematically in FIG. 2. While the components of FIG. 1 cannot be equated exactly with the components of FIG. 2 some of the components of FIG. 2 have numbers similar to those used in FIG. 1 to illustrate the similarity therebetween.

Figure 2:
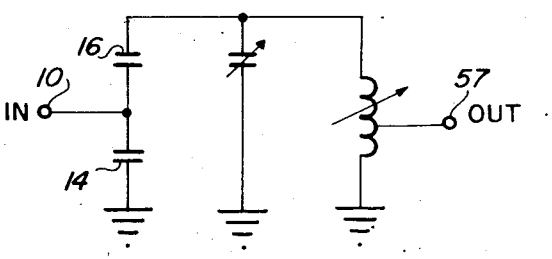
FIG. 2 is an equivalent circuit of the apparatus of FIG. 1.

Basically, the length of transmission line 20 operates as an inductance with the second lengths of transmission line 40, 41 and 42 operating to decrease the inductance of the transmission line 20 when the PIN diodes associated therewith are operated into the conducting mode. When the PIN diodes 45, 50, and/or 53 are non-conducting the associated lengths of transmission line are grounded only at one end and couple differently to transmission line 20 than when the PIN diodes are conducting and both ends of their associated transmission line are grounded. Thus, the variable inductance illustrated in the equivalent circuit of FIG. 2 represents not only the first length of transmission line 20 but also the second lengths of transmission line 40, 41 and 42. Similarly, the variable capacitor in the equivalent circuit FIG. 2 represents the four capacitors 27 through 30. In addition, the PIN diodes which provide the switching action have a small amount of capacitance which must be taken into account during the design of the circuit. For example, in the present embodiment each of the PIN diodes has a total capacitance of approximately 1.05 picofarads.

FIG. 3 illustrates a partially assembled incrementally tuned RF filter embodying the schematic of FIG. 1. In this embodiment the lengths of transmission line are formed on a glass Teflon substrate 60 having a dielectric constant of approximately 2.5. Components which are assembled in FIG. 3 are designated with a number similar to the number designating the schematic representation thereof in FIG. 1. Some of the components, such as the RF chokes and the input and output transmission lines are not included in the structure of FIG. 3. The capacitors 27 through 30 are formed by screening a single layer of conducting material onto an alumina substrate 61. The alumina substrate is utilized because of the high dielectric constant (approximately 10) which provides sufficient capacitance in a relatively small area. The overall size of the structure illustrated in FIG. 3 (the length of which is less than one inch) can be appreciated more fully from the dimensions illustrated in FIG. 1. L1, which is the distance from the left end of transmission line 20 to the left end of transmission line 40, is 0.110 inches. L2, which is the length of transmission line 40, is 0.450 inches. L3, which is the length of transmission line 41, is 0.225 inches. L4, which is the length of transmission line 42, is 0.1125 inches. L5, which is the distance that RF output 58 is spaced from the right end of transmission line 20, is 0.2125 inches. The capacitances of the various capacitors are listed below.

| CAPACITOR | VALUE IN PICOFARADS |
|---|---|
| 14 | 56 |
| 16 | 18 |
| 27 | 6.8 |
| 28 | 4.7 |
| 29 | 3.0 |
| 30 | 1.8 |
| 46 | 330 |
| 51 | 330 |
| 54 | 330 |

The embodiment illustrated in FIGS. 1 and 3 is constructed to operate over a range of approximately 300 to 400 MHz with the various increments being illustrated in FIGS. 4A and B. FIG. 4A illustrates the coarse increments which are accomplished by switching PIN diodes 22 through 25 to include different amounts of capacitance in the circuit. For example, when all of the PIN diodes 22 through 25 are activated, all of the capacitances 27 through 30 are in the circuit to provide the maximum amount of capacitance and, therefore, the lowest increment of frequency. Each of the coarse increments can be divided into a plurality of fine increments, one of which is illustrated in FIG. 4B. As the PIN diodes 45, 50 and 53 are activated, the different lengths of transmission line 40, 41 and 42 are switched into the circuit to decrease the inductance and increase the frequency. Thus, the minimum inductance is achieved when all three PIN diodes 45, 50 and 53 are activated so that all three lengths of transmission line 40, 41 and 42 are grounded at both ends. To lower the frequency in approximately equal increments the following steps are followed. The next lower increment is achieved by deactivating PIN diode 53 to remove the ground at one end of transmission line 42. A third step is achieved by deactivating PIN diode 50 and reactivating PIN diode 53. A fourth step is achieved by again deactivating PIN diode 53 so that only PIN diode 45 is activated. A fifth step is achieved by deactivating PIN diode 45 and reactivating PIN diodes 50 and 53. A sixth step is achieved by deactivating PIN diode 53 so that only PIN diode 50 is activated. In the final step PIN diode 53 is the only diode which is activated. It will of course be understood by those skilled in the art that additional steps can be provided by incorporating additional sections of transmission line and by providing different coupling therebetween. Also, it will be understood that in some applications it may be desirable to vary only the capacitance or only the inductance and that variations in both inductance and capacitance are shown in this embodiment because of the number and uniformity of increments which can be achieved.

Figure 5:
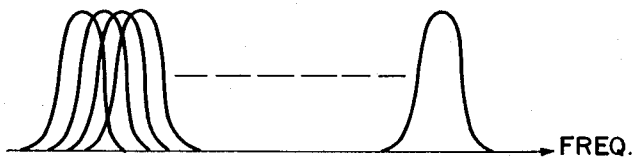
FIG. 5 is a graphic representation of the bandpass frequency response of the various modes of operation of the structure of FIG. 1.

FIG. 5 graphically illustrates the bandpass of the filter at each of the increments. It is desirable to construct the RF filter so that the filter has an approximately equal bandwidth for each increment across the frequency range. This was accomplished in the present embodiment through the use of the dimensions and capacitance values listed above. Further, the width of the transmission lines 20, 40, 41 and 42 is 0.120 inches, the spacing S is 0.060 inches between the transmission line 20 and each of the transmission lines 40, 41 and 42. The thickness of the substrate on which the transmission lines are formed is 0.120 inches. It will of course be understood that many other embodiments may be provided at different frequency ranges and that different materials, capacitance values and dimensions might be utilized. Further, more or less steps may be desired in the fine or course tuning.

Figure 6:
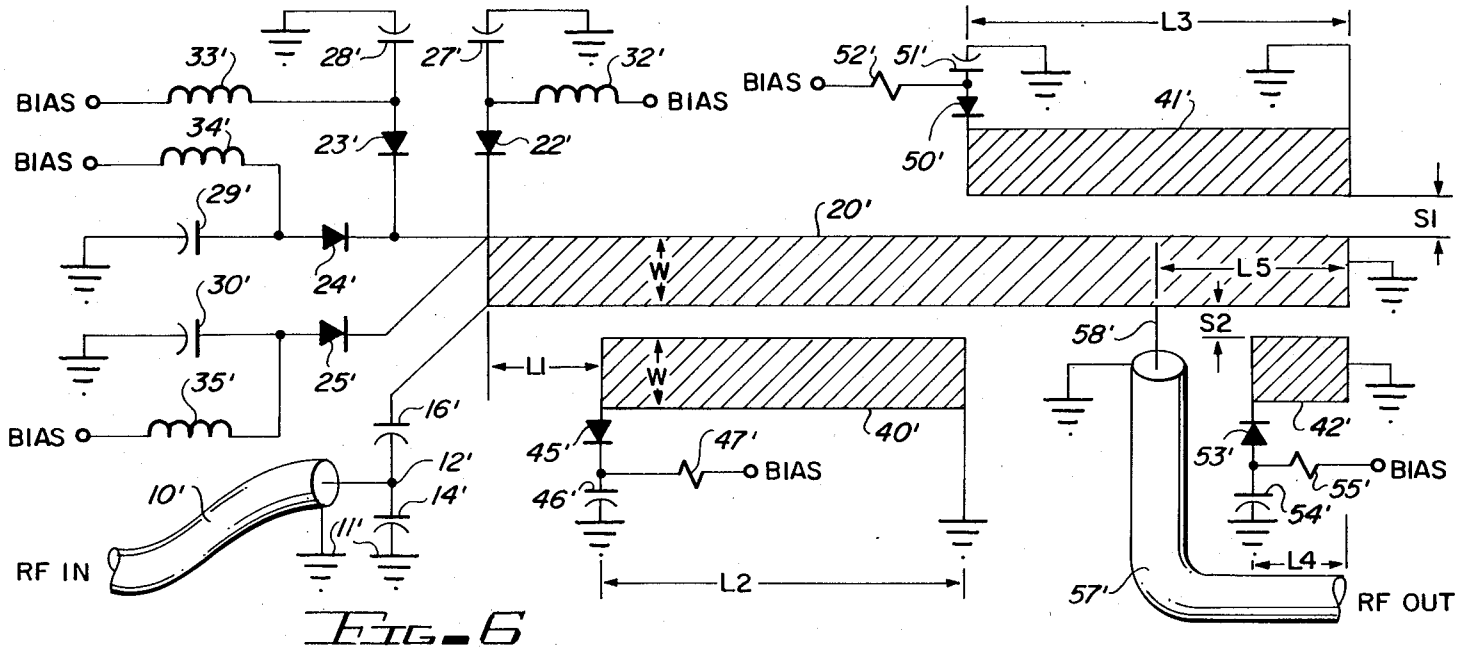
FIG. 6 is a schematic diagram of a second incrementally tuned RF filter embodying the present invention.
Figure 7B:
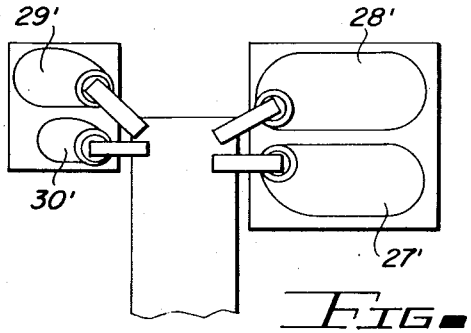
FIGS. 7 A, B and C are pictoral representations of the structure illustrated schematically in FIG. 6.
Figure 7C:
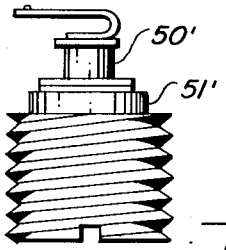
Figure 7A:
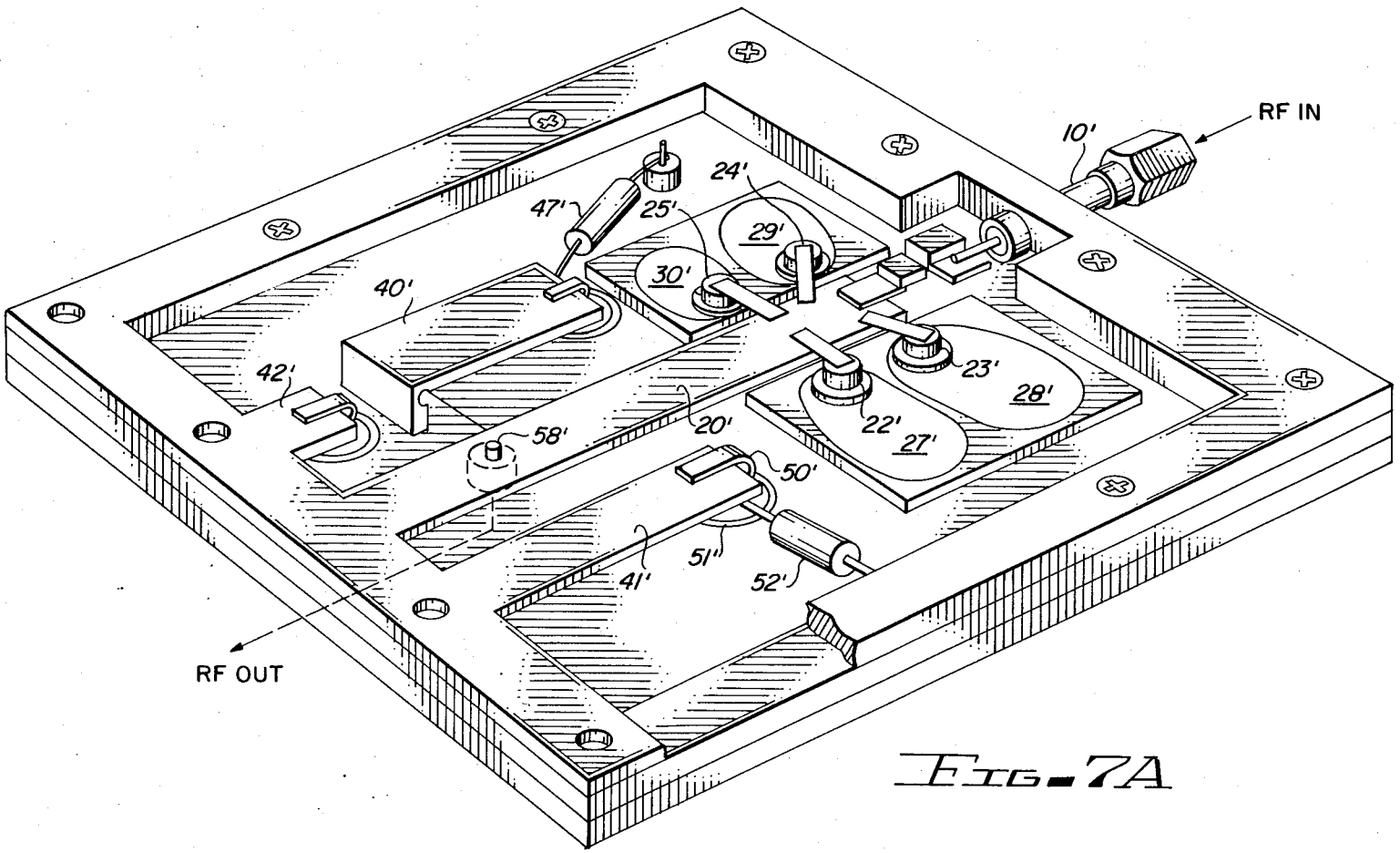

FIG. 6 is schematic diagram of another embodiment utilizing an air dielectric. FIG. 7 is a perspective view of an assembly of the air dielectric structure illustrated schematically in FIG. 6. In general, the embodiment illustrated in FIGS. 1 and 3 has a more rugged construction and is smaller than the air dielectric structure of FIGS. 6 and 7. In some instances the larger structure may be desirable because of higher power operation and, further, the air dielectric structure has a higher Q. Aside from the air dielectric and the dimensions and capacitive values, the structure of FIG. 6 differs from that of FIG. 1 only in the structure for connecting the second lengths of transmission line into the circuitry. In the schematic of FIG. 6 all of the components which are similar to those in FIG. 1 have been designated with similar numbers and all of the numbers have a prime added to indicate a different embodiment.

Each of the second lengths of transmission line 40', 41' and 42', have one end connected directly to ground and the other end connected through PIN diode 45', 50' and 53', respectively, to one side of an RF capacitor 46', 51' and 54', respectively. The opposite side of the capacitors are connected to ground. The junction between the PIN diodes and capacitors are adapted to receive a bias voltage by way of a resistor 47', 52' and 55', respectively, instead of through the RF choke illustrated in the embodiment of FIG. 1. This embodiment for switching the second lengths of transmission line in the circuitry is utilized to illustrate another possible embodiment and because, as will be seen from FIG. 7, it is easier to implement in the air dielectric structure. Referring to FIG. 7, it can be seen that the second lengths of transmission line 41' and 42' are constructed as an integral portion of a conducting frame and, by situating the PIN diodes and RF capacitors together at one end they can be easily mounted between the cantilevered ends of the transmission lines and the ground plane. This specific embodiment is illustrated in greater detail in FIG. 7C. FIG. 7C illustrates a spring contact at the top thereof, a PIN diode (50' in this example) and a ceramic capacitor (51' in this example). FIG. 7B illustrates a top view of the four capacitors 27' through 30' and their connections to the transmission line 20'. The dimensions of the transmission lines for the embodiment illustrated in FIGS. 6 and 7 are listed below.

| Dimension | Inches |
|---|---|
| L1 | 0.100 |
| L2 | 0.710 |
| L3 | 0.534 |
| L4 | 0.178 |
| 45 | 0.336 |
| S1 | 0.80 |
| S2 | 0.60 |
| W | 0.240 |

-continued

| Dimension | Inches |
|---|---|
| T (substrate) | 0.150 |

The capacitive values are the same as those listed above for the embodiment illustrated in FIGS. 1 and 3.

Thus, two embodiments of a new and improved incrementally tuned RF filter are illustrated, each embodiment of which has some advantages in construction and operation. Further, the RF filter is constructed to provide a number of coarse and fine increments over a predetermined frequency range. The RF filter is further designed so that the bandwidths at the various increments are approximately equal. While the specific embodiments illustrated are designed for use as a resonator in an RF power oscillator circuit, it will be understood by those skilled in the art that modifications can be made thereto to provide an RF filter for other uses, such as the front end of a receiver or at a relatively high power level in a transmitter chain or the like.

While we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

We claim:

1. An incrementally tuned RF filter comprising:

a first length of transmission line formed to have a predetermined inductance at a desired frequency range;

a plurality of capacitors;

a plurality of second lengths of transmission line mounted in RF coupled proximity with said first length; and a plurality of PIN diodes, each independently operable into conducting and nonconducting modes, said PIN diodes being coupled to said first length of transmission line and said second lengths of transmission line and each of the plurality of capacitors being coupled to a first end of the first length of transmission line by a different one of the plurality of PIN diodes to produce an RF filter with a different center frequency in each mode of each of said PIN diodes.

2. An incrementally tuned RF filter as claimed in claim 1 wherein respective bias input means are connected to electrical junctions coupling each respective capacitor and PIN diode for receiving a bias to operate the PIN diode into one of the two modes.

3. An incrementally tuned RF filter as claimed in claim 2 wherein a second end of the first length of transmission line is coupled to an electrical common point and each of the plurality of capacitors is coupled to the common point to complete an electrical circuit.

4. An incrementally tuned RF filter as claimed in claim 3 wherein impedance matching signal input means are coupled to the first end of the first length of transmission line and an output is connected to the first length of transmission line at a position in spaced relation to the second end thereof.

5. An incrementally tuned RF filter as claimed in claim 1 wherein the second lengths of transmission line are each RF coupled to an electrical common point at one end and each coupled to the common point at a second end by a different one of the plurality of PIN diodes.

6. An incrementally tuned RF filter as claimed in claim 5 wherein bias input means are connected to the one end of each of the second lengths of transmission line for receiving a bias to operate the PIN diode coupled to the second end thereof into one of the two modes.

7. An incrementally tuned RF filter as claimed in claim 1 wherein the first and second lengths of transmission line are strip type transmission lines edge coupled for inductive coupling.

8. An incrementally tuned RF filter as claimed in claim 1 wherein the first length of transmission line, the plurality of capacitors and the plurality of second lengths of transmission line are all constructed and mounted to provide substantially equal bandwidths of tuning across the desired frequency range.

9. An incrementally tuned RF filter comprising:

a first length of transmission line formed to have a predetermined inductance at a desired frequency range;

a capacitor coupled to said first length of transmission line to form a resonant circuit therewith;

a plurality of second lengths of transmission line mounted in RF coupled proximity with said first length; and a plurality of PIN diodes, each independently operable into conducting and nonconducting modes, said PIN diodes being coupled to said first length of transmission line and said second lengths of transmission line to produce an RF filter with a different center frequency in each mode of each of said PIN diodes.

10. An incrementally tuned RF filter comprising:

a first length of strip type transmission line having one end coupled to an electrical common point, an impedance matching signal input coupled to the other end thereof, and an output coupled thereto at a position in spaced relation to the one end;

a plurality of PIN diodes each independently operable into one of a conducting and nonconducting mode;

a plurality of second lengths of strip type transmission line mounted adjacent to said first length to provide RF coupling therebetween, each of said second lengths having one end RF coupled to the electrical common point, and a second end of each of said second lengths being coupled to the electrical common point by a different one of said PIN diodes;

a plurality of capacitors each having one terminal coupled to the other end of said first length of transmission line by different ones of said plurality of PIN diodes and a second terminal coupled to the electrical common point; and bias input means coupled to the one terminal of each of said plurality of capacitors and to the one end of each of said plurality of second lengths of transmission line for receiving a bias thereon to operate each of the PIN diodes individually into a selected one of the two modes.

* * * * *